United States Patent [19]

Hirschkoff

[11] Patent Number: 4,676,417

[45] Date of Patent: Jun. 30, 1987

[54] SKI CARRIER

[76] Inventor: Richard Hirschkoff, 11349 Victoria Ave., Los Angeles, Calif. 90066

[21] Appl. No.: 851,963

[22] Filed: Apr. 14, 1986

[51] Int. Cl.[4] ..... A45F 3/02

[52] U.S. Cl. ..... 224/202; 224/151; 2/312

[58] Field of Search ..... 2/312, 311; 224/917, 224/202, 205, 151, 257, 258, 150

[56] References Cited

U.S. PATENT DOCUMENTS 2,530,695 11/1950 Helmert ..... 224/917 X 3,841,542 10/1974 Hogensen ..... 224/917 X 3,960,302 6/1976 Mazzoni, Jr. ..... 224/257 X

*Primary Examiner*—Stephen Marcus

*Assistant Examiner*—David Voorhees

*Attorney, Agent, or Firm*—Saul Epstein

[57] ABSTRACT

A carrier for skis which converts to a belt when not in use. An adjustable length carrying strap includes a pocket at each end which house retractable holding straps for fastening around skis. The holding straps are faced with Velcro material so that the skis can be conveniently held. When not being used to hold skis, the holding straps are retracted into the pockets of the carrying strap so that the carrying strap can be used as an attractive belt.

6 Claims, 5 Drawing Figures

SKI CARRIER

BACKGROUND OF THE INVENTION

1. Field of the Invention

This invention relates to carriers for skis and more particularly to a carrier which can be stored as a belt when the user is wearing the skis.

2. Prior Art

There have been numerous ski carriers devised in the past, but most are bulky and are a nuisance when the user arrives on the slope to ski. The difficulty is that the skier must find a place to store the carrier while it is not in use. There have been some proposals of possible solutions to this problem, including at least one ski carrier designed to be worn as a belt while skiing. However, this carrier, which is described in U.S. Pat. No. 2,530,695, suffers from the disadvantage that the means used to hold the skis are exposed at each end of the carrying strap, so that when it is worn as a belt it is somewhat unsightly.

Accordingly, it is an object of the present invention to provide a ski carrier which can be worn as a belt when not in use, and which has provisions for hiding the ski holding means when not in use so as to present an attractive appearance.

SUMMARY OF THE INVENTION

The main structure of the invented ski carrier/belt is a carrying strap which is preferably made of nylon or polypropylene webbing and which has an adjustable length. At each end of the carrying strap are pockets which house retractable ski holding straps. The holding straps are partially faced with Velcro hook loop fasteners material so that they will adhere to each other and can be wrapped around the skis to retain them. Three straps are preferably contained in each pocket. Two of the holding straps at each end of the carrying strap are used to hold a pair of skis while the third, in cooperation with one of the straps holding the skis, can be used to hold ski poles. The ski holding straps are attached at spaced points on the skis and poles so that when the carrier is draped over a skier's shoulder, the skis can be comfortably carried.

When not in use carrying skis, the ski straps can be retracted and the carrier worn as a belt.

Other features of the invention will become apparent from the description of the presently preferred embodiment of the invention which follows.

DETAILED DESCRIPTION OF THE INVENTION

Figure 1:
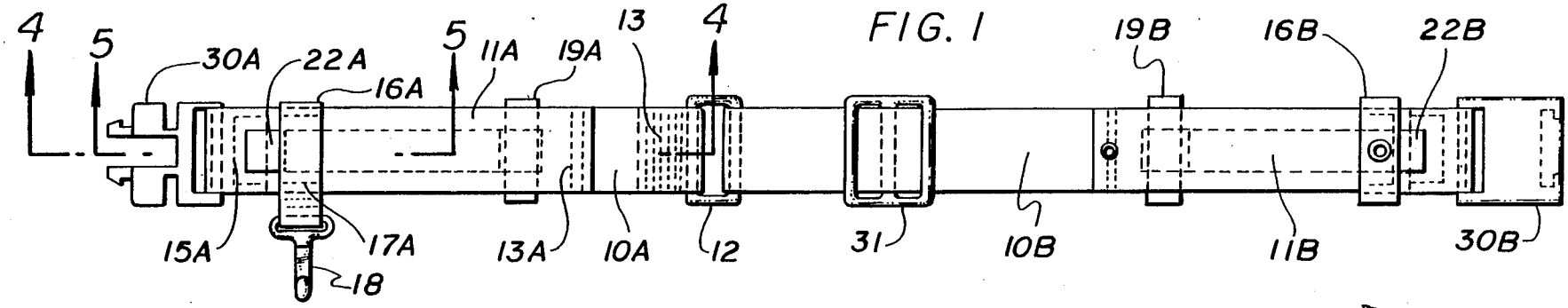
FIG. 1 is a plan view of the invented ski carrier with the holding straps retracted.

Referring to the drawings, a presently preferred embodiment of the invention is illustrated showing a carrying strap comprised of two sections 10A and 10B coupled together by ring 12. There are many possible belting materials which could be used to make the carrying strap sections, but nylon or polypropylene webbing are preferred. The two sections of the carrying strap have many similarities, and in order to simplify the explanation, similar components are designated by the same number but differentiated by an A or a B suffix depending on which end of the carrying strap is being referred to. The parts so designated are similar, but not necessarily identical.

Strap section 10A is folded over one leg of ring 12 and sewn adjacent to the leg as indicated by stitching 13. The other end of strap section 10A is wrapped around a cross member of buckle half 30A and is secured to the buckle half by stitching 15A. Pocket cover 11A which is preferably fabricated from the same belting material as carrying strap 10A, is sewn to section 10A at 13A. It extends generally parallel to the strap section, terminating at a loop 16A which surrounds both pocket cover 11A and strap section 10A near buckle half 30A. Loop 16A is also preferably made of the same belting material as are the strap sections, but narrower, and is sewn separately to pocket cover 11A and strap section 10A. The stitching to pocket cover 11A is shown at 17A. A pocket to provide an out of view receptacle for straps used to hold the skis is formed between strap section 10A and pocket cover 11A. The mouth of the pocket is formed by loop 16A. Loop 16A can be extended, if desired, to hold a snap hook as shown at 18 in FIG. 1. Snap hook 18 can be used, for example, to hold gloves.

Figure 4:
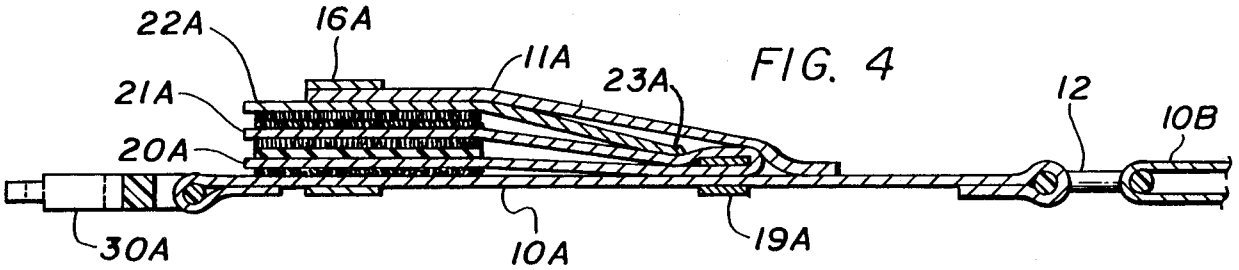
FIG. 4 is a cross sectional view of one end of the ski carrier taken at 4—4 of FIG. 1.
Figure 5:
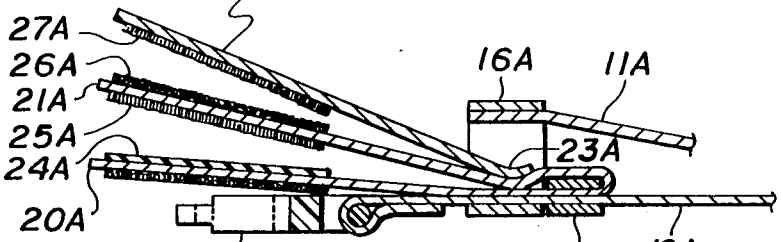
FIG. 5 is a cross sectional view showing a section taken at 5—5 of FIG. 1, but with the holding straps extended.

A slide 19A surrounds strap section 10A and is free to slide between the stitching 13 and loop 16A. Ski holding straps 20A and 21A, comprised of a single piece of belting material narrower than strap 10A, is wrapped around the leg of slide 19A between strap section 10A and pocket cover 11A. A third holding strap 22A is sewn to straps 20A and 21A at 23A. For ease in recognizing strap 22A, it can be made of webbing of a different color, if desired. As slide 19A is slid toward stitching 13A, holding straps 20A, 21A and 22A retract into the pocket formed by strap sections 10A, pocket cover 11A, and loop 16A. Sliding slide 19 toward buckle half 30A exposes the holding straps 20A, 21A and 22A as can be seen in FIG. 5. It should be noted that the thickness of straps 20A, 21A and 22A as seen in FIGS. 4 and 5 is exaggerated so that the details of construction can be readily seen. In actual practice, the straps are relatively thin and the pile of three straps in the strap pocket do not form such a bulky structure as is suggested by the drawings.

The free ends of holding straps 20A, 21A and 22A each carry patches of Velcro material on one or both sides and one carries a patch of rubberlike material on one side. Specifically, the preferred arrangement of the patches to facilitate the holding of skis and ski poles can be seen by reference to FIG. 5 where a slip resisting rubberlike material patch 24A is shown attached to the top surface of strap 20A and a loop type Velcro patch 25A is shown on the bottom surface. Strap 21A has a Velcro patch on both the top and bottom surfaces, the bottom patch having a hook polarity and the top patch having a loop polarity. Finally, strap 22A has hook Velcro patch 28A on its under surface. The manner in which these patches are mated to hold the skis and poles is described below.

Carrying strap section 10B is fastened to the center bar of triple bar slide 31, fed around a leg of ring 12, and back through triple bar slide 31 so that section 10B becomes an adjustable length strap. The free end of section 10B is attached to buckle half 30 . Buckle half 30B is the mate to buckle half 30A so that by adjusting the strap length to the appropriate length, the carrying strap can be worn around a person's waist as a belt.

A slide 19B, with attached ski holding straps 20B, 21B, and 22B slides along strap 10B in a manner similar to corresponding parts 19A, 20A, 21A and 22A on strap section 10A. Also, a pocket comprised of pocket cover llB and loop 16B adjacent to buckle half 30B is similar to a corresponding pocket adjacent to buckle half 30A. Holding straps 20B, 21B and 22B also have the rubber-like patch and Velcro patches as do their A counterparts. If desired, two spaced snap connectors 28 may be fastened to pocket cover llB. A small pouch with mating snaps may then be attached to carry glasses, money, or other small articles.

Figure 3:
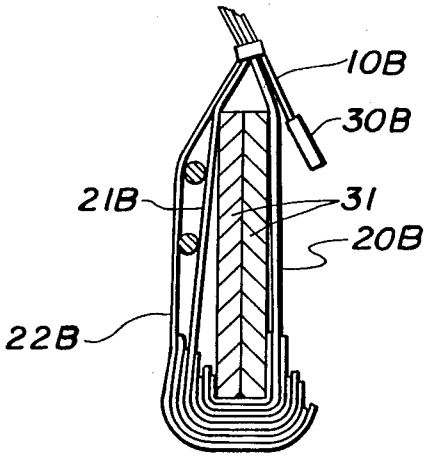
FIG. 3 is a view taken at 3—3 of FIG. 2.
Figure 2:
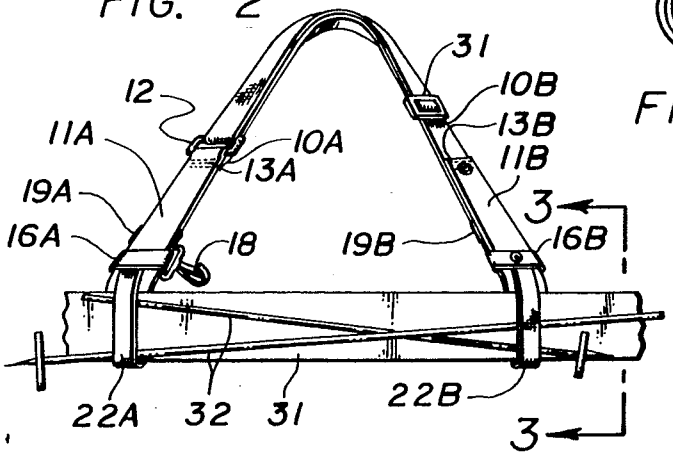
FIG. 2 shows the invented ski carrier attached to a pair of skis and ski poles.

The two sets of retractable holding straps (20, 21, and 22, A and B) are made long enough to wrap around a pair of skis and ski poles with enough overlap of the Velcro patches to assure secure fastening. To use, the retractable straps at one end of the carrier are extended and wrapped around a pair of skis 31 as illustrated in FIG. 3. The rubberized pad on strap 20 is first run under the ski edges and then strap 21 is wrapped tightly over strap 20. The mating Velcro patches on the straps will hold the skis in place. The operation is repeated using holding straps 20 and 21 at the other end of the carrying strap and encircling the skis at a second point spaced from the first as shown in FIG. 2. Ski poles 32 may then be held against the side of the skis where straps 21 are located, and straps 22 wrapped around the poles with the Velcro patches mating with the outside patches on straps 21. The skis and poles can then be easily carried to the point where they are to be used, preferably by using carrying strap 10 as a shoulder strap. When the carrying strap is removed from the skis, the holding straps may be retracted by sliding slides 19 inboard effectively hiding them. The carrier can then be worn as a belt while the user is skiing so that no storage place need be found to store the carrier.

What has been described is a novel ski carrier which can be stored around the user's waist as a belt while he or she is skiing. Various modifications will no doubt occur to those skilled in the art and such modifications are intended to be covered by the following claims:

I claim:

1. A ski carrier which comprises:

(a) an elongated carrying strap;

(b) a pair of slide members slidable along said carrying strap;

(c) first and second pluralities of holding straps, each holding strap having one end attached to one of said pair of slide members;

(d) complementary Velcro hook and loop fasteners patches at the free ends of at least two of each of said pluralities of holding straps for holding skis;

(e) a pocket at each end of said elongated carrying strap, said holding straps being retracted into said pocket when said slide members are slid toward the middle of said elongated carrying strap and said holding straps being exposed when said slide members are slid toward the ends of said carrying strap; and (f) mating buckle means at the ends of said elongated carrying strap for holding said elongated carrying strap around the waist of a person.

2. A ski carrier as recited in claim 1 where each of said pluralities of holding straps includes three straps, one of said holding straps having a Velcro hook and loop fasteners patch on both sides of said strap at the free end thereof, and the other two of said holding straps having Velcro hook and loop fasteners patches on one side thereof.

3. A ski carrier as recited in claim 2 and further including a patch of slip resisting material opposite the Velcro hook and loop fasteners patch on one of said straps having one Velcro hook and loop fastener patch.

4. A ski carrier as recited in claim 1 wherein said pocket means comprises:

(a) a pocket cover comprised of strapping having substantially the same width as said carrying strap and having one end attached to said carrying strap at a point spaced from said buckle means;

(b) a loop attached to and surrounding said carrying strap between the point of attachment of said pocket cover and said buckle means, the second end of said pocket cover also being attached to said loop, each of said slides being slidable between the points of attachment of one of said pocket covers to said carrying strap and to said loop.

5. A ski carrier as recited in claim 4 where each of said pluralities of holding straps includes three straps, one of said holding straps having a Velcro hook and loop fasteners patch on both sides of said strap at the free end thereof, and the other two of said holding straps having, Velcro hook and loop fasteners patches on one side thereof.

6. A ski carrier as recited in claim 5 and further including a patch of slip resisting material opposite the Velcro hook and loop fasteners patch on one of said straps having one Velcro hook and loop fasteners patch.

* * * * *